US007878946B1

(12) United States Patent
Felts

(10) Patent No.: US 7,878,946 B1
(45) Date of Patent: Feb. 1, 2011

(54) SPINNING BIKE POWER METER

(75) Inventor: John T. Felts, Alameda, CA (US)

(73) Assignee: NanoScale Surface Systems, Inc., Alameda, CA (US)

( * ) Notice: Subject to any disclaimer, the term of this patent is extended or adjusted under 35 U.S.C. 154(b) by 0 days.

(21) Appl. No.: 12/207,951

(22) Filed: Sep. 10, 2008

(51) Int. Cl.
*A63B 71/00* (2006.01)
*A63B 22/06* (2006.01)

(52) U.S. Cl. ..... 482/8; 482/57; 482/900

(58) Field of Classification Search ..... 482/1, 482/8, 57, 114, 119, 900; 73/379.01, 379.06, 73/379.07
See application file for complete search history.

(56) References Cited

U.S. PATENT DOCUMENTS 4,241,603 A * 12/1980 Han et al. ..... 73/129
4,775,145 A * 10/1988 Tsuyama ..... 482/63
4,817,939 A * 4/1989 Augspurger et al. ..... 482/61
5,319,555 A * 6/1994 Iwaki et al. ..... 701/57
6,491,606 B1 * 12/2002 Swift ..... 482/57
7,560,822 B1 * 7/2009 Hoffmann ..... 290/1 R
2002/0155929 A1 * 10/2002 Lull et al. ..... 482/57
2004/0053750 A1 * 3/2004 Forcillo ..... 482/57
2009/0026026 A1 * 1/2009 Martino ..... 188/218 XL
2009/0026027 A1 * 1/2009 Martino ..... 188/218 XL

OTHER PUBLICATIONS

Lim, "Introduction to Training with Power", pp. 1-16 [online]. Retrieved on Aug. 29, 2008 from the Internet: <URL:http://www.cycleops.com/t-powerBasics.aspx>.

* cited by examiner

*Primary Examiner*—Loan Thanh
*Assistant Examiner*—Sundhara M Ganesan
(74) *Attorney, Agent, or Firm*—Gunnison, McKay & Hodgson, L.L.P.; Serge J. Hodgson

(57) ABSTRACT

An exercise bicycle includes a flywheel, a drive train coupled to the flywheel, and pedals coupled to the drive train. A user of the exercise bicycle expends power by exerting force on the pedals to spin the flywheel. The exercise bicycle further includes a power meter. The power meter includes a friction pad comprising a flywheel contact surface in contact with the flywheel and a temperature sensor located within the friction pad. The temperature sensor measures the temperature of the flywheel contact surface. The power meter further includes an output meter coupled to the temperature sensor, the output meter converting a temperature change of the flywheel contact surface as measured by the temperature sensor into a calculated power expended by the user.

14 Claims, 2 Drawing Sheets

SPINNING BIKE POWER METER

FIELD OF THE INVENTION

The present invention relates generally to exercise equipment and in particular to a method and apparatus for measuring power generated by a user on a spin type bicycle.

BACKGROUND OF THE INVENTION

The exercise industry has moved forward from using simple resistance techniques to create a resistive force to push against, to using heart rate monitors to determine actual physical exertion. Most recently, user power output on bicycles has gained acceptance as a more accurate determination of actual physical exertion. Power meters by several companies are available based on several approaches. Strain gauges that measure the forces applied to bicycle cranks attached to the pedals of a bicycle have been shown to be the most accurate, while strain gauges installed in the rear wheel hub measuring the forces applied to the wheel through the chain can also determine the power that a rider is exerting. Other techniques include measuring the chain vibration (although this has been shown to be less accurate).

Power measurement can significantly enhance ones ability to exercise in a controlled manner and can be used to determine direct physical improvements in both endurance and muscular power. When coupled with heart rate measurement, power and heart rate can be used to determine overall fitness improvements.

Unfortunately, the currently available power measurement techniques are only applicable to the traditional bicycle and have not been applied to the common exercise bicycle due to the significant cost of the power measuring devices which can exceed the cost of the exercise bike. CycleOp™ currently manufactures a commercially available exercise bike, commonly called a spin bike, although the cost of the bike is several thousand dollars due in large part to the power measurement device.

If a low cost technique could be found that provides repeatable power measurement, the significant advantages of current bicycle power measurement could be translated to exercise (spin) bikes in health clubs and private homes. This would allow more controlled exercise and would enable the user to determine actual improvements in fitness over time. Furthermore, current exercise bikes (spin bikes) are highly variable based on bike to bike comparisons, so that workouts are difficult to gauge from day to day. The implementation of a power meter would significantly improve the repeatability of the exercise experience on a day to day and even week to week basis.

SUMMARY OF THE INVENTION

An embodiment provides a power measuring technique that is accurate and inexpensive to implement on exercise (spin) bicycles.

In accordance with one embodiment, a power measuring device is provided that includes a friction pad in contact with a flywheel of an exercise bike. A temperature measuring device is imbedded in the friction pad without penetrating the friction pad through to the flywheel.

As the user increases the force of the friction pad on the flywheel through a mechanical means, friction between the friction pad and the spinning flywheel increases, resulting in increased temperature of the friction pad which is directly measured by the temperature measuring device.

In accordance with one embodiment, temperature measurements are converted to a power measurement providing a direct output to the user of a measurement of the power generated during exercise.

In one embodiment, a thermocouple wire is used as the temperature measuring device.

In accordance with another embodiment, a multilayer friction pad assembly based on varying materials with specific thermal conductivities is presented.

These and other features of the present invention will be more readily apparent from the detailed description set forth below taken in conjunction with the accompanying drawings.

BRIEF DESCRIPTION OF THE DRAWINGS

In the following description, the same or similar elements are labeled with the same or similar reference numbers.

DESCRIPTION

In accordance with one embodiment, a method and apparatus for measuring power generated by a user on a spin type bike is presented.

Figure 1:
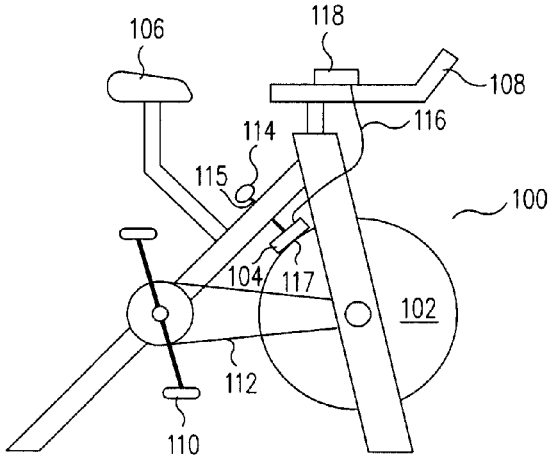
FIG. 1 is a side view of a spin bike with a flywheel and a power sensor that measures power based on a temperature sensor in contact with a friction pad in accordance with one embodiment.

FIG. 1 is a side view of a spin bike 100 including a flywheel 102 and a friction pad 104. Friction pad 104 makes contact with flywheel 102. Flywheel 102 is constructed of a thin cylindrical shaped metal disk with significant weight.

Friction pad 104 creates friction and increased work to a user when friction pad 104 is in contact with flywheel 102. The user sits on a seat 106 that supports the weight of the user. The user also can stabilize the user's position and move on and off of seat 106 by holding handlebars 108. Handlebars 108 are typically a bar with two areas at each end to position the user's hands.

Pedals 110 are small platforms connected to a drive train 112 of spin bike 100 that allows the user to push through the soles of the user's feet and translate the user's energy into forward rotational motion of flywheel 102. Drive train 112 can include gears and a chain or pulleys and a belt. Drive train 112 allows the force applied through pedals 110 to be translated to flywheel 102.

Flywheel 102 is typically of significant weight so that once flywheel 102 is in motion from the force of the user through pedals 110 and drive train 112, little power is required by the user to continue motion of flywheel 102. To increase the work required by the user and therefore increase the user's energy output, an adjusting knob 114 is connected to a shaft 115 connected to friction pad 104. Adjusting knob 114 is turned to either increase the force of friction pad 104 on flywheel 102 or to decrease the force.

In one embodiment, friction pad 104 is outfitted with a temperature sensor 116 or similar device that can measure temperature changes in a flywheel contact surface 117 of friction pad 104 contacting flywheel 102. Since flywheel contact surface 117 of friction pad 104 is in intimate, i.e., direct, contact with flywheel 102, the friction between flywheel contact surface 117 of friction pad 104 and flywheel 102 will generate heat as flywheel 102 spins.

The heat that is generated is directly related to the force that the user applies to pedals 110 that are coupled to flywheel 102 through drive train 112 to maintain any given rotational speed of flywheel 102. The higher the friction and the faster the rotational speed, the higher the force that is applied by the user to pedals 110.

The higher friction and rotational speed translate into higher temperature of flywheel contact surface 117 of friction pad 104.

One can directly determine the power output, Q, knowing an empirically derived power conversion factor, Pcf, and the temperature change as set forth in the following relationship (1):

$$Q=(T\text{ exercise}-T\text{ ambient})*\text{Pcf}$$

Temperature, i.e., T exercise and T ambient, is measured in Celsius, the power conversion factor, Pcf, is given in Watts/Celsius. Note that the starting ambient temperature, T ambient, is simply the temperature of flywheel contact surface 117 of friction pad 104 prior to beginning exercise. Further, the current temperature, T exercise, is simply the temperature of flywheel contact surface 117 of friction pad 104 during exercise.

In one embodiment, the power conversion factor, Pcf, is empirically determined as follows. The starting ambient temperature, T ambient, of flywheel contact surface 117 of friction pad 104 is measured prior to spinning of flywheel 102. A known power input, i.e., Q, is applied to drive train 112, e.g., from a motor to spin flywheel 102. After flywheel 102 reaches a constant temperature, the temperature, T exercise, is measured. The power conversion factor, Pcf, is then calculated from the following relationship (2):

$$\text{Pcf}=Q/(T\text{ exercise}-T\text{ ambient}).$$

In one embodiment, the power is determined by temperature sensor 116, for example a wire thermocouple that is directly connected to flywheel contact surface 117 of friction pad 104 in direct contact with flywheel 102 in FIG. 1. Flywheel 102 is put into motion through drive train 112 to pedals 110 by the user positioned on seat 106 holding handlebars 108.

Temperature sensor 116 is slightly spaced apart from flywheel contact surface 117, with a portion of friction pad 104 in between. Accordingly, a small temperature drop will occur between flywheel contact surface 117 and temperature sensor 116. However, this temperature drop is negligible. Thus, the temperature measured by temperature sensor 116 is referred to herein as the temperature of flywheel contact surface 117.

An output meter 118 is coupled to temperature sensor 116 that is directly coupled to flywheel contact surface 117 of friction pad 104 in contact with flywheel 102. Prior to any exercise, output meter 118 registers the starting ambient temperature, i.e., T ambient, through temperature sensor 116. The ambient temperature, sometimes called baseline temperature, is subtracted from all subsequent temperature measurements.

Upon initiation of exercise, the user, sometimes called rider, adjusts adjusting knob 114, sometimes called a tension knob, by turning adjusting knob 114 to increase the force applied by friction pad 104 against flywheel 102. Higher tensions result in higher forces required on pedals 110 by the user transferred through drive train 112 to flywheel 102. These higher tensions result in higher friction between flywheel contact surface 117 of friction pad 104 and flywheel 102 leading to a higher temperature of flywheel contact surface 117 of friction pad 104.

The higher temperature is measured by output meter 118 through temperature sensor 116 with the starting ambient temperature subtracted to determine the actual temperature increase, i.e., temperature change, that is the result of the force applied by the user to pedals 110. The temperature change is then multiplied by the pre-determined power conversion factor, resulting in a value, i.e., calculated power, that is displayed to the user on output meter 118 mounted at handlebars 108.

Decreasing the friction with adjusting knob 114 reduces the contact force between flywheel contact surface 117 of friction pad 104 and flywheel 102. This, in turn, results in a lower temperature difference between ambient temperature and the measured exercise temperature, which results in a lower calculated power displayed at output meter 118.

Since output meter 118 is a simple device that converts the measured temperature change to a calculated power reading that is displayed to the user, many different types of electronic display devices can be used to calculate the power and display the results.

The output meter 118 can also measure the user's heart rate and other cycling functions that are typically determined by a common bike computer, such as speed, cadence and room temperature. Furthermore, the output meter 118 can display power, heart rate and the other measurements above in numerical, graphical or tabular form. Generally, friction pad 104, temperature sensor 116, and output meter 118 form a power meter, sometimes called a power measuring device or power sensor.

Figure 2:
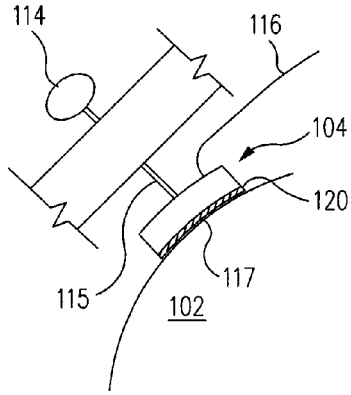
FIG. 2 is an enlarged side view of the friction pad in contact with the flywheel of FIG. 1.

FIG. 2 is an enlarged side view of friction pad 104 in contact with flywheel 102 of FIG. 1. In FIG. 2, more detail of friction pad 104 and connection of friction pad 104 to output meter 118, sometimes called a power meter, via temperature sensor 116 is illustrated. The simple configuration illustrated in FIG. 2 results in a metering system that can be readily implemented on a wide range of spin type exercise bikes, or other exercise equipment that uses friction based systems to apply resistive forces for the user to oppose.

An example of a temperature sensor that can be used as temperature sensor 116 is a type "K" thermocouple which has an error of +/−0.75% of readings above 0° C. which is sufficient for this application in one embodiment. A specific example of a type "K" thermocouple is Cole Parmer catalog #K-08439-62.

Since the temperature measurement is referenced to the starting ambient temperature, absolute temperature measurement is not critical. Only the temperature difference between the ambient and exercise temperatures is important.

More particularly, temperature sensor 116 is mounted in a position in contact with flywheel contact surface 117 of a friction pad surface material 120 of friction pad 104 that is in actual contact with flywheel 102. Since friction pad 104 sometimes does not contact flywheel 102 over the entire flywheel contact surface 117, temperature sensor 116, for example a thermocouple wire, is placed in a location on flywheel contact surface 117 where flywheel contact surface 117 always contacts flywheel 102. In one embodiment, temperature sensor 116 is located in the center of friction pad 104 as determined from the distance side to side and should be centered (as much as possible) in the center of flywheel 102 width.

Figure 3:
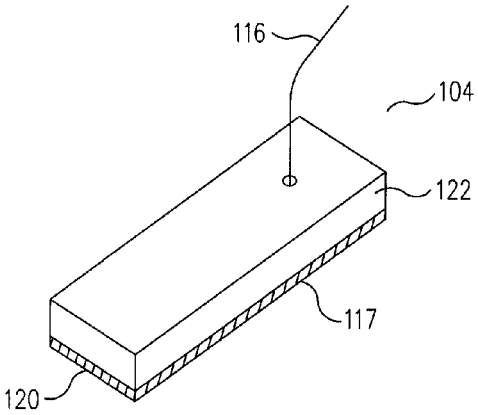
FIG. 3 is a perspective view of the friction pad of FIG. 2.

FIG. 3 is a perspective view of friction pad 104 of FIG. 2. Referring now to FIGS. 2 and 3 together, friction pad 104 includes two materials in one embodiment. More particularly, friction pad 104 includes friction pad surface material 120 that contacts flywheel 102 and a support material 122.

Support material 122 acts as a structural support of friction pad surface material 120 to insure that the relative shape and position on flywheel 102 of friction pad surface material 120 does not change as a function of the tension that is applied via adjusting knob 114. Since friction pad surface material 120 is typically a poor thermal conductor, support material 122 has little to no impact on the temperature changes in friction pad surface material 120. This is also why temperature sensor 116 contacts friction pad surface material 120 in the area directly in contact with flywheel 102 without protruding through friction pad surface material 120 itself. Friction pad surface material 120 includes flywheel contact surface 117 as an outer surface in direct contact with flywheel 102.

Figure 4:
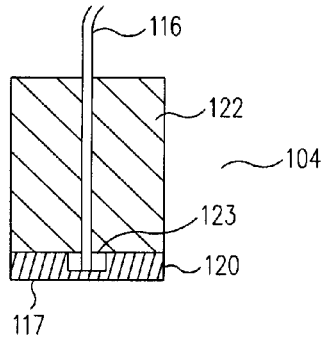
FIG. 4 is a cross-sectional view of the friction pad of FIG. 3.

FIG. 4 is a cross-sectional view of friction pad 104 of FIG. 3. Friction pad 104 includes friction pad surface material 120, support material 122 and temperature sensor 116. Temperature sensor 116 extends through support material 122 to friction pad surface material 120, e.g., through a hole in support material 120 as illustrated. Temperature sensor 116 is constructed in such a way that temperature sensor 116 directly contacts friction pad surface material 120 without protruding through friction pad surface material 120. To insure that friction pad surface material 120 is not punctured, a countersunk hole 123 is formed in friction pad surface material 120 to insure that temperature sensor 116 is as close as possible to flywheel contact surface 117 of friction pad surface material 120.

Figure 5:
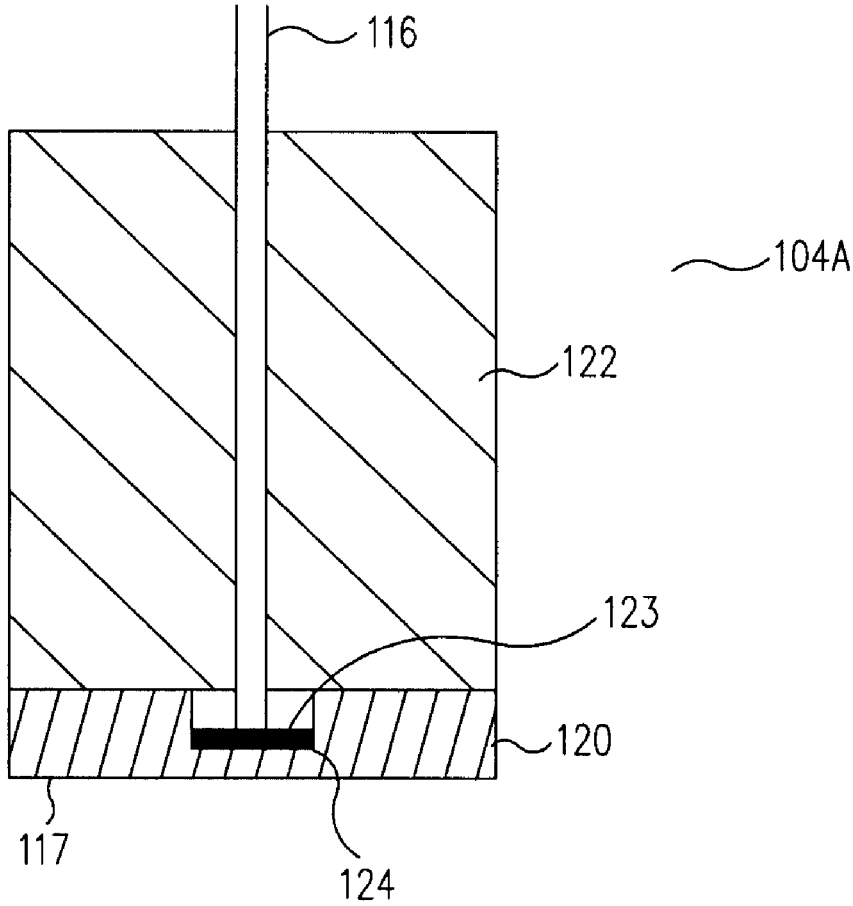
FIG. 5 is a cross-sectional view of a friction pad in accordance with another embodiment.

FIG. 5 is a cross-sectional view of a friction pad 104A in accordance with another embodiment. Friction pad 104A of FIG. 5 is similar to friction pad 104 of FIG. 4 and only the significant differences are discussed below.

In this embodiment, countersunk hole 123 is filled with a high thermally conductive material 124. High thermally conductive material 124 allows the thermal energy, i.e., heat, generated between friction pad surface material 120 and flywheel 102 to be "collected" and more readily transmitted to temperature sensor 116, sometimes called a thermal sensor. More particularly, high thermally conductive material 124 has a thermal conductivity greater than a thermal conductivity of friction pad surface material 120.

Table 1 lists some friction pad surface materials 120 that are suitable for use on spin cycles and other exercise equipment.

TABLE 1

| Common Friction Pad Materials |
|---|
| Material |
| Cotton |
| Leather |
| Cork |
| Mineral Insulation |

The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. An exercise bicycle comprising:

a flywheel;

a drive train coupled to the flywheel;

pedals coupled to the drive train, wherein a user of the exercise bicycle expends power by exerting force on the pedals to spin the flywheel; and a power meter, wherein the power meter comprises:

a friction pad comprising a flywheel contact surface in contact with the flywheel, a temperature sensor located within the friction pad, the temperature sensor measuring temperature of the flywheel contact surface; and an output meter coupled to the temperature sensor, the output meter converting a temperature change of the flywheel contact surface as measured by the temperature sensor into a calculated power expended by the user.

2. The exercise bicycle of claim 1 further comprising a seat for supporting the user.

3. The exercise bicycle of claim 1 further comprising handlebars.

4. The exercise bicycle of claim 3 wherein the output meter is mounted on the handlebars.

5. The exercise bicycle of claim 1 further comprising an adjusting knob for adjusting the contact force between the flywheel contact surface and the flywheel.

6. The exercise bicycle of claim 5 further comprising a shaft connecting the adjusting knob to the friction pad.

7. The exercise bicycle of claim 1 wherein the friction pad comprises:

a friction pad surface material comprising the flywheel contact surface; and a support material for supporting the friction pad surface material.

8. The exercise bicycle of claim 7 wherein the friction pad surface material is selected from the group consisting of cotton, leather, cork and mineral insulation.

9. The exercise bicycle of claim 7 wherein the friction pad surface material comprises a countersunk hole.

10. The exercise bicycle of claim 9 wherein the temperature sensor is located within the countersunk hole.

11. The exercise bicycle of claim 10 further comprising a material within the countersunk hole having a thermal conductivity greater than a thermal conductivity of the friction pad surface material.

12. The exercise bicycle of claim 1 wherein the temperature sensor comprises a thermocouple.

13. The exercise bicycle of claim 1 wherein the calculated power is directly determined from the temperature change and a power conversion factor.

14. The exercise bicycle of claim 1 wherein the temperature change is the difference between the temperature of the flywheel contact surface prior to the user exerting force on the pedals to spin the flywheel and the temperature of the flywheel contact surface while the user exerts force on the pedals and spins the flywheel.

* * * * *